US009915914B2

(12) United States Patent
Omura

(10) Patent No.: US 9,915,914 B2
(45) Date of Patent: Mar. 13, 2018

(54) IMAGE FORMING APPARATUS INCLUDING PHOTOCONDUCTOR DRUM

(71) Applicant: KYOCERA Document Solutions Inc., Osaka-shi, Osaka (JP)

(72) Inventor: Hiroyoshi Omura, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/373,109

(22) Filed: Dec. 8, 2016

(65) Prior Publication Data

US 2017/0168450 A1 Jun. 15, 2017

(30) Foreign Application Priority Data

Dec. 11, 2015 (JP) ..... 2015-241834

(51) Int. Cl.
*G03G 21/18* (2006.01)
*G03G 21/16* (2006.01)
*G03G 15/00* (2006.01)

(52) U.S. Cl.
CPC ..... *G03G 21/1647* (2013.01); *G03G 21/1842* (2013.01); *G03G 15/757* (2013.01); *G03G 2215/0132* (2013.01)

(58) Field of Classification Search
None
See application file for complete search history.

(56) References Cited

U.S. PATENT DOCUMENTS

2001/0051059 A1* 12/2001 Morikami ..... G03G 21/1619 399/121
2008/0170880 A1* 7/2008 Hashimoto ..... G03G 21/186 399/106
2015/0063867 A1* 3/2015 Yasumoto ..... G03G 21/1832 399/114
2017/0315478 A1* 11/2017 Tsuji ..... G03G 15/1605
2017/0364020 A1* 12/2017 Kashimoto ..... G03G 15/757

FOREIGN PATENT DOCUMENTS

JP 2009015126 A 1/2009

* cited by examiner

*Primary Examiner* — Thomas Giampaolo, II
(74) *Attorney, Agent, or Firm* — Alleman Hall Creasman & Tuttle LLP

(57) ABSTRACT

A drum unit of an image forming apparatus including a flange that is integrally provided with the photoconductor drum. A frame rotatably supports the photoconductor drum and covers its side. A gear portion is integrally formed with an outer circumferential surface of the flange. An outer diameter of the gear portion is larger than a diameter size of the photoconductor drum. A guide member is provided on an upper surface of the frame and guides the edge portion upward when the drum unit is pulled out of the apparatus main body. An upper surface of the guide member includes first and second guide surfaces. The first guide surface is located more on a side of a center of the photoconductor drum than the edge position, and the second guide surface is located more on the side of the insertion direction than the edge position.

4 Claims, 7 Drawing Sheets

IMAGE FORMING APPARATUS INCLUDING PHOTOCONDUCTOR DRUM

INCORPORATION BY REFERENCE

This application is based upon and claims the benefit of priority from the corresponding Japanese Patent Application No. 2015-241834 filed on Dec. 11, 2015, the entire contents of which are incorporated herein by reference.

BACKGROUND

The present disclosure relates to an image forming apparatus such as a copier or a multifunction peripheral, and in particular relates to an image forming apparatus including a photoconductor drum used in a process of forming an image on a sheet.

An image forming apparatus of an electrophotographic system includes a photoconductor drum on which a toner image is formed by a developing device. The toner image formed on the photoconductor drum is transferred to a transfer belt by a primary transfer device, and is further transferred from the transfer belt to a sheet by a secondary transfer device. The photoconductor drum is unitized into a drum unit together with a frame and the like, wherein the frame rotatably supports the photoconductor drum. The drum unit including the photoconductor drum is attached to the image forming apparatus in a detachable manner. There is known, as one example of conventional image forming apparatuses, an image forming apparatus to/from which the drum unit is inserted and pulled out horizontally.

As one example of such drum units, there is known a drum unit that includes a flange fixed to an end portion of the photoconductor drum in the axial direction. The flange is integrally formed with a gear portion that transmits a rotational driving force to another driven body.

SUMMARY

An image forming apparatus according to an aspect of the present disclosure includes an apparatus main body, a drum unit, and a transfer belt. The drum unit is attached, in a detachable manner, to a predetermined attachment position inside the apparatus main body. The drum unit includes a cylindrical photoconductor drum and is configured to be inserted and pulled out horizontally with respect to the apparatus main body. The transfer belt is disposed above the photoconductor drum in such a way as to face and contact an outer circumferential surface of the photoconductor drum in a state where the drum unit is disposed at the attachment position. The drum unit includes a flange, a frame, a gear, and a guide member. The flange is integrally provided with the photoconductor drum by being fixed to an inner hole of a side end portion of the photoconductor drum, the side end portion being on a side of an insertion direction of the drum unit opposite to a pulling out direction. The frame is configured to rotatably support the photoconductor drum and cover a side of the photoconductor drum. The gear portion is integrally formed with an outer circumferential surface of the flange, wherein an outer diameter of the gear portion is larger than a diameter size of the photoconductor drum. The guide member is provided on an upper surface of the frame and extends in the insertion direction and the pulling out direction on both sides of an edge position, wherein the edge position is a position at which an edge portion, on the side of the insertion direction, of a surface of the transfer belt facing the photoconductor drum, is disposed in the state where the drum unit is disposed at the attachment position, and the guide member is configured to guide the edge portion upward when the drum unit is pulled out of the apparatus main body. An upper surface of the guide member includes a first guide surface and a second guide surface, wherein the first guide surface is located more on a side of a center of the photoconductor drum than the edge position, and the second guide surface is located more on the side of the insertion direction than the edge position. The first guide surface is lower than a height position of a lower end of the edge portion, and the second guide surface is higher than an upper-end position of the gear portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
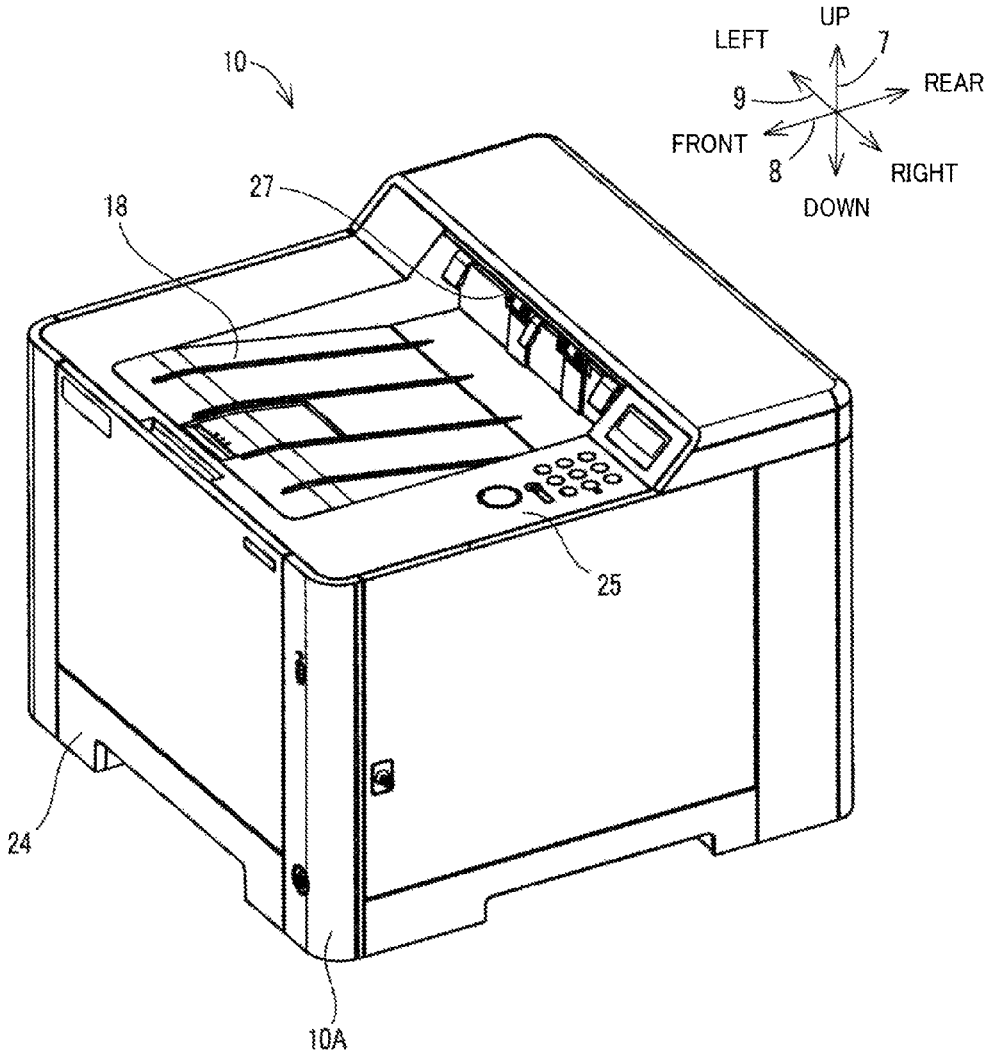
FIG. 1 is a perspective view showing a configuration of an image forming apparatus according to an embodiment of the present disclosure.

The following describes an embodiment of the present disclosure with reference to the attached drawings. It should be noted that the following embodiment is an example of a specific embodiment of the present disclosure and should not limit the technical scope of the present disclosure. It is noted that, for the sake of explanation, a vertical direction in an installed state of an image forming apparatus 10 where the image forming apparatus 10 is usable (the state shown in FIG. 1) is defined as an up-down direction 7. In addition, a front-rear direction 8 is defined on a supposition that a side to/from which a sheet feed cassette 24 shown in FIG. 1 is inserted and pulled out in the installed state is a front side. Furthermore, a left-right direction 9 is defined based on the front side of the image forming apparatus 10 in the installed state.

The image forming apparatus 10 according to the present embodiment has at least a print function. The image forming apparatus 10 is a so-called tandem-type color printer.

Figure 2:
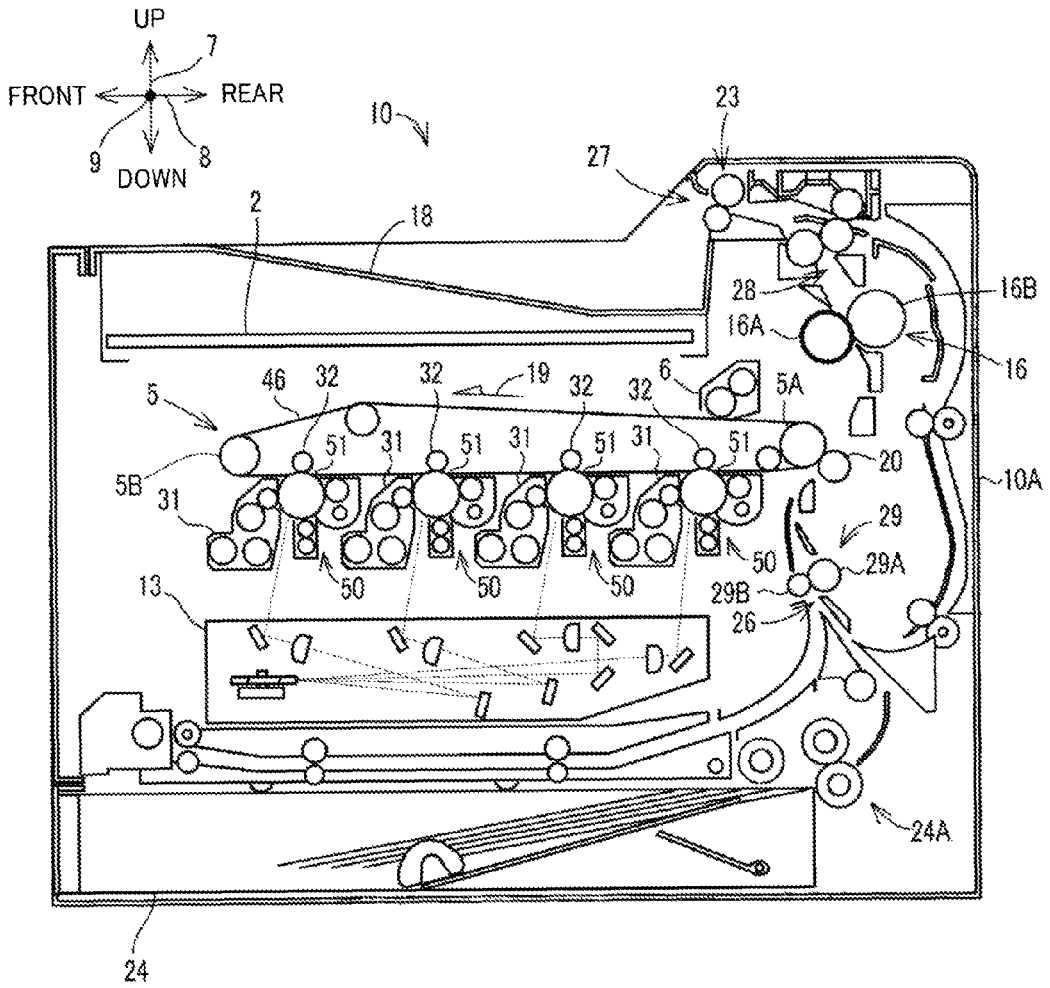
FIG. 2 is a cross-sectional view showing an internal configuration of the image forming apparatus.

As shown in FIG. 1 and FIG. 2, the image forming apparatus 10 includes a housing 10A (an example of the apparatus main body). The housing 10A has an approximately rectangular parallelepiped shape as a whole. Some of the components constituting the image forming apparatus 10 are stored in the housing 10A.

As shown in FIG. 2, the image forming apparatus 10 includes four image forming units 4, an intermediate transfer unit 5, a laser scanning device 13, a secondary transfer roller 20, a fixing device 16, a sheet discharge tray 18, the sheet feed cassette 24, an operation/display portion 25 (see FIG. 1), a belt cleaning device 6, and a control portion 2.

Each of the image forming units 4 includes a developing device 31, a primary transfer roller 32, and a drum unit 50 including a photoconductor drum 51, and forms an image by the electrophotography system. The image forming units 4 are arranged in alignment along the front-rear direction 8 in the housing 10A, and form a color image based on a so-called tandem system. The image forming units 4 form a color toner image on a transfer belt 46 by transferring toner images of different colors from the photoconductor drums 51 to the transfer belt 46 such that the toner images are overlaid with each other. The toner image on the transfer belt 46 is transferred by the secondary transfer roller 20 to a printing sheet fed from the sheet feed cassette 24.

Figure 3:
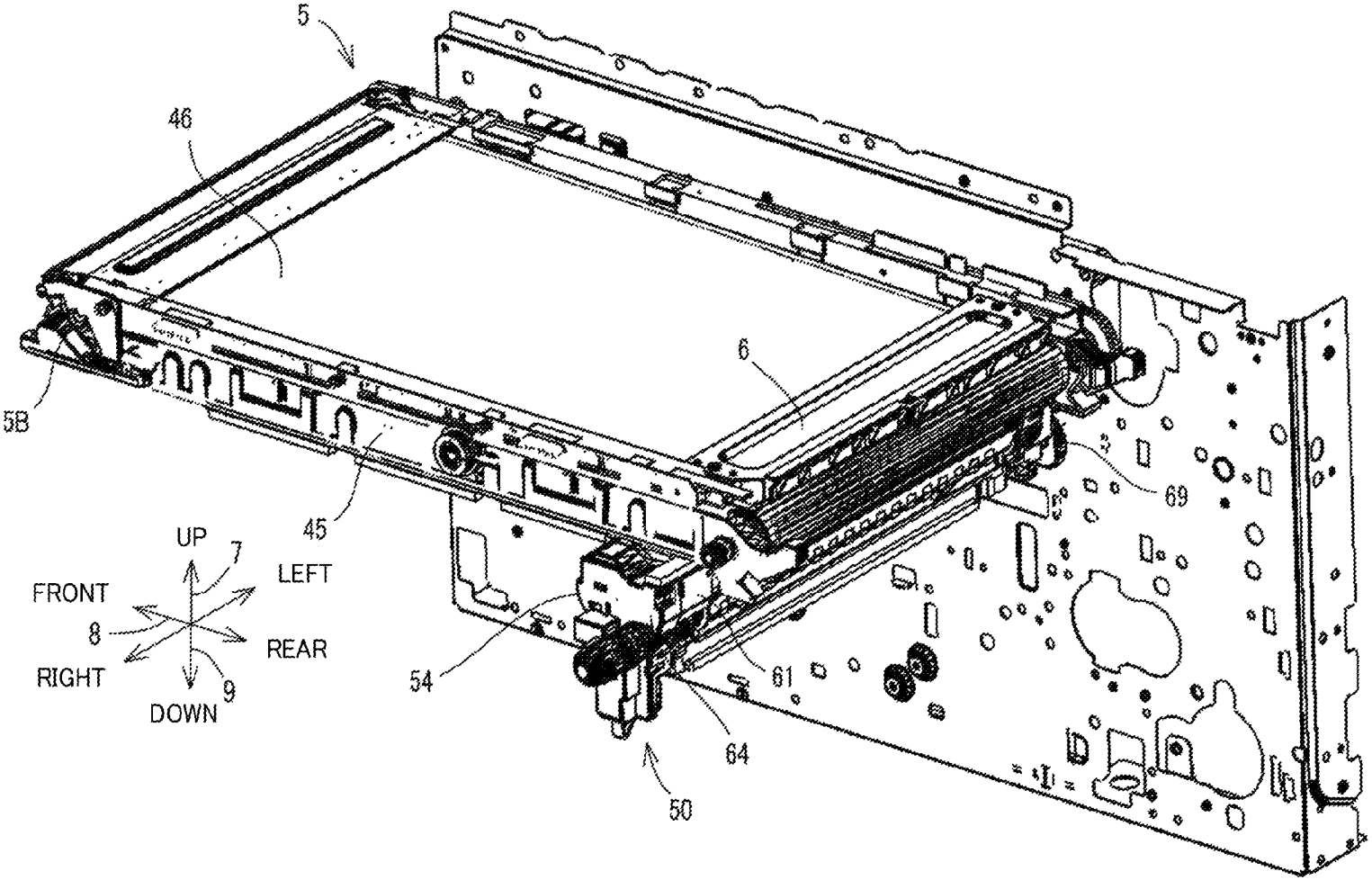
FIG. 3 is a perspective view showing disposal positions of an intermediate transfer unit and a drum unit included in the image forming apparatus.

The intermediate transfer unit 5 is provided above the four image forming units 4. That is, the intermediate transfer unit 5 is provided above the four drum units 50. As shown in FIG. 3, the intermediate transfer unit 5 includes a main body frame 45 and a transfer belt 46. In addition, a driving pulley 5A and a driven pulley 5B are provided at opposite ends of the main body frame 45 in the front-rear direction 8. The transfer belt 46 is supported by the driving pulley 5A and the driven pulley 5B by being suspended therebetween. This enables the belt surface of the transfer belt 46 to extend horizontally in the front-rear direction 8. The transfer belt 46 can move in a direction indicated by the arrow 19 while the surface thereof is in contact with the surfaces of the photoconductor drums 51. In the present embodiment, the transfer belt 46 is supported in such a way as to face and contact the outer circumferential surfaces of the photoconductor drums 51 in a state where the drum units 50 are disposed at predetermined attachment positions in the housing 10A.

Specifically, the transfer belt 46 is an annular belt member. The width of the transfer belt 46 is equal to the longitudinal length of the photoconductor drums 51. The transfer belt 46 includes a base layer portion and a surface layer portion that is formed on the surface of the base layer portion. The base layer portion is formed from a thermoplastic resin. For example, the thermoplastic resin is PC (polycarbonate), PVDF (polyvinylidene fluoride), PA (nylon), or PBT (polybutylene terephthalate). The surface layer portion is formed by coating the base layer portion with a thermosetting resin. For example, the thermosetting resin is PI (polyimide), PAI (polyamideimide), or AC (acrylic).

Each drum unit 50 includes a photoconductor drum 51. The photoconductor drum 51 is formed in a cylindrical shape, and is made by forming a thin photoconductive layer of an amorphous silicon (a-Si) photoconductive material on the surface of a blank pipe made of aluminum. That is, the photoconductive layer is formed on the surface of the photoconductor drum 51. An electrostatic latent image is formed on the photoconductive layer. The photoconductor drums 51 are disposed under the primary transfer rollers 32 respectively, and the transfer belt 46 is held at nip portions between the photoconductor drums 51 and the primary transfer rollers 32. It is noted that the drum unit 50 is described below.

The laser scanning device 13 is provided below the four image forming units 4. The laser scanning device 13 generates laser beams based on image data of respective colors input thereto, and irradiates the laser beams to the surfaces of the photoconductor drums 51 of the drum units 50. This allows electrostatic latent images to be formed on the surfaces of the photoconductive layers of the photoconductor drums 51.

The sheet feed cassette 24 is provided in a bottom portion (the lowest portion) of the housing 10A. Printing sheets of a predetermined size are stored in the sheet feed cassette 24. The sheet feed cassette 24 is supported in the housing 10A in a detachable manner. The sheet feed cassette 24 is attached to a predetermined attachment position in the housing 10A. A vertical conveyance path 26 is formed in a rear side inside the housing 10A, wherein the vertical conveyance path 26 extends from the sheet feed cassette 24 to the fixing device 16 via the secondary transfer roller 20. In addition, a sheet feed unit 24A is provided in proximity to a rear-end portion of the sheet feed cassette 24. In a state where the sheet feed cassette 24 is attached to the attachment position, the sheet feed unit 24A picks up, one by one, the printing sheets stacked on the sheet feed cassette 24, and feeds the printing sheet toward the vertical conveyance path 26.

The secondary transfer roller 20 is provided in the rear side inside the housing 10A at a position facing the driving pulley 5A. The toner image is transferred from the transfer belt 46 to the printing sheet by the secondary transfer roller 20.

The fixing device 16 is provided above the secondary transfer roller 20. The fixing device 16 fixes the toner image to the printing sheet by adding heat to the printing sheet. The fixing device 16 includes a pair of rollers: a heating roller 16A and a pressure roller 16B. In the fixing device 16, the printing sheet conveyed thereto from the secondary transfer roller 20 is conveyed while being nipped between the heating roller 16A and the pressure roller 16B. At this time, heat is transmitted from the heating roller 16A to the printing sheet, and the toner on the printing sheet is fused and fixed to the printing sheet. This allows a color image to be formed on the printing sheet.

As shown in FIG. 2, a discharge path 28 is formed to extend from the fixing device 16 to a sheet discharge port 27. In the discharge path 28, a pair of discharge rollers 23 is provided near the sheet discharge port 27. The pair of discharge rollers 23 is composed of a driving roller 23A and a driven roller 23B, wherein the driven roller 23B is pressed in contact by the driving roller 23A. The printing sheet that has passed through the fixing device 16 is conveyed in the discharge path 28, and then discharged to the sheet discharge tray 18 from the sheet discharge port 27 by the pair of discharge rollers 23.

The following describes the photoconductor drum 51 and the configuration of the drum unit 50 that includes the photoconductor drum 51, with reference to FIG. 3 to FIG. 7B.

Figure 4:
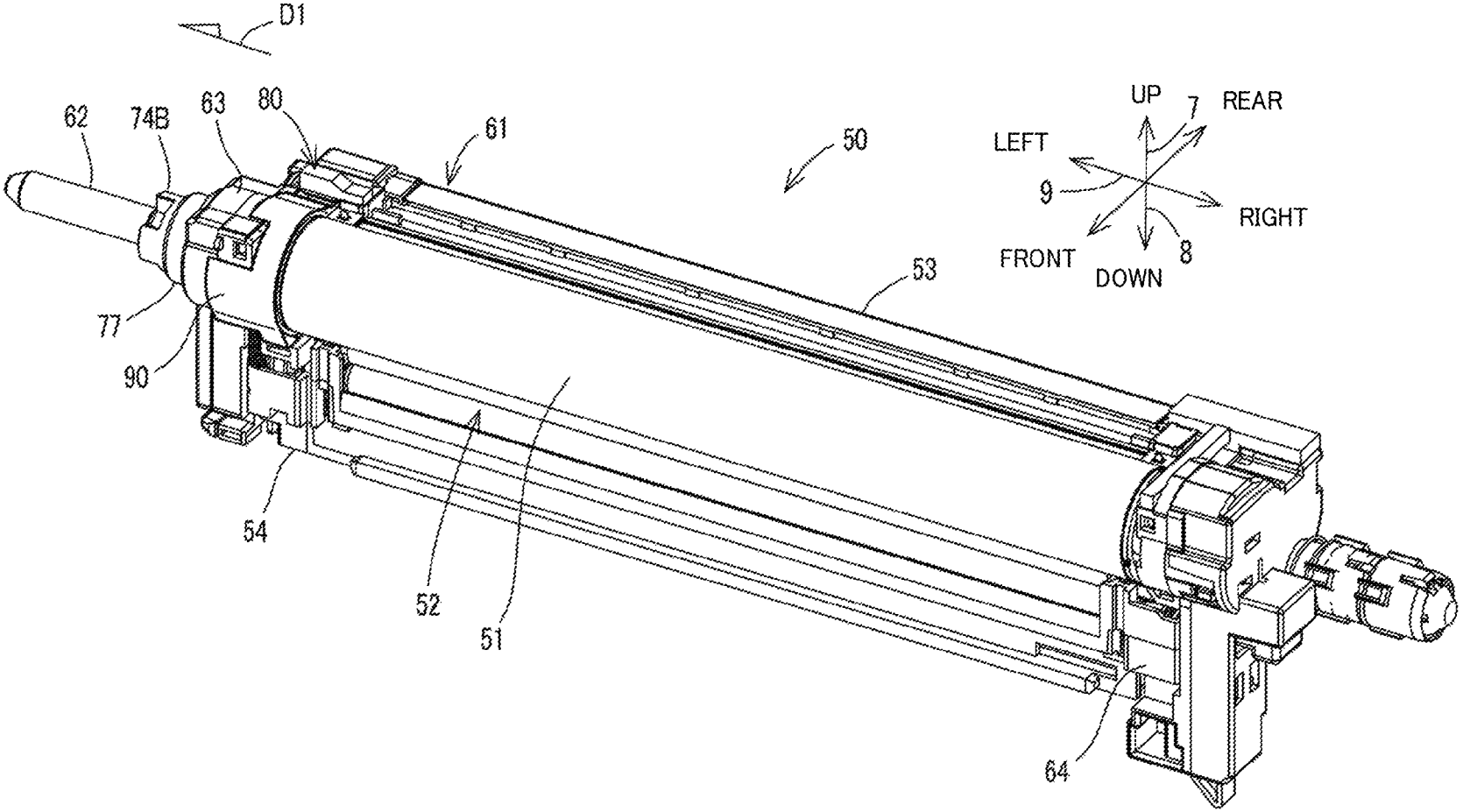
FIG. 4 is a perspective view of the drum unit.

As described above, the image forming apparatus 10 includes the drum unit 50. The drum unit 50 rotatably supports the photoconductor drum 51, and as shown in FIG. 4, includes the photoconductor drum 51, a charging roller 52 (an example of the transmitted portion of the present disclosure), a cleaning portion 53, and a frame 54 that supports these portions. In addition, the drum unit 50 includes a rotation shaft 62 that rotatably supports the photoconductor drum 51. The rotation shaft 62 is supported by the frame 54. That is, the photoconductor drum 51 is unitized by being attached to the frame 54, together with the charging roller 52, the cleaning portion 53, the rotation shaft 62 and the like.

The charging roller 52 is configured to uniformly charge the surface of the photoconductor drum 51 to a certain potential, and is a roller-like rotator. The charging roller 52 is provided below the photoconductor drum 51. A support shaft is provided on each of opposite ends of the charging roller 52 in the longitudinal direction. The support shafts are rotatably supported by the frame 54. The cleaning portion 53 is configured to remove toner that has remained on the surface of the photoconductor drum 51, and includes, in an inside thereof, cleaning members such as a brush roller and a cleaning blade. The cleaning portion 53 is integrally attached to the frame 54.

Figure 5:
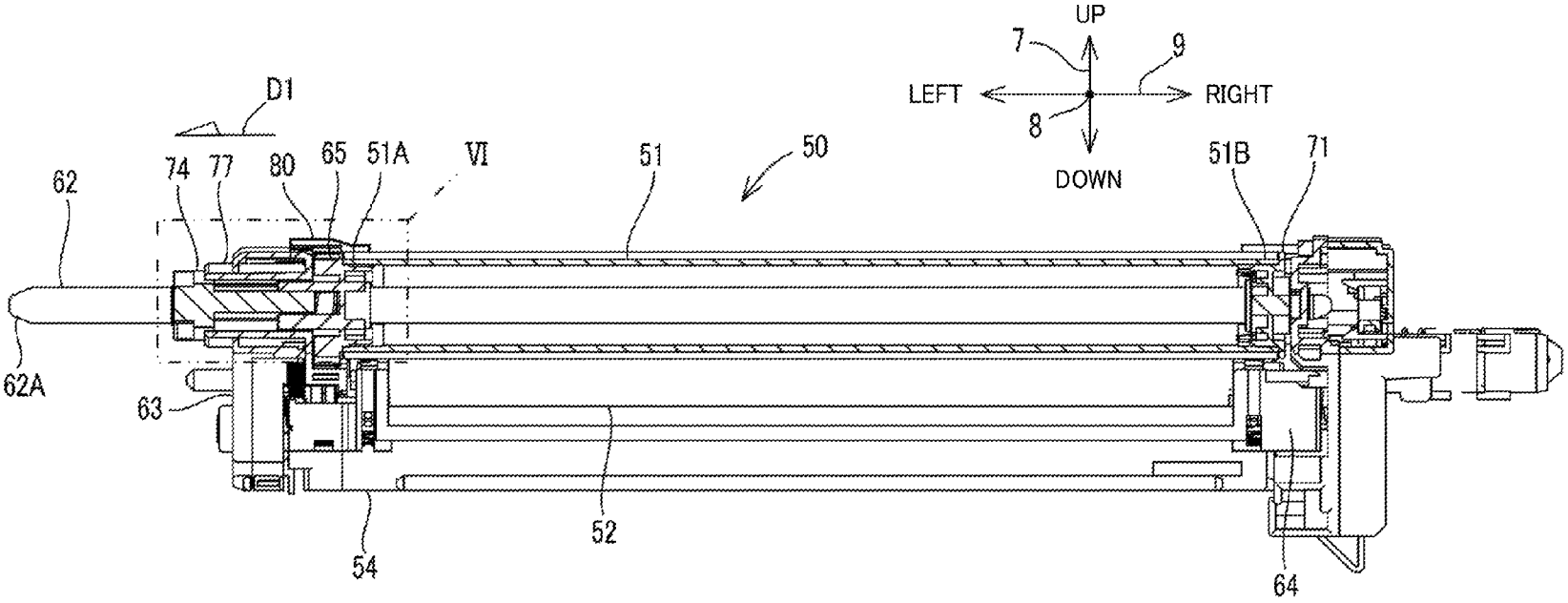
FIG. 5 is a cross-sectional view showing an internal configuration of the drum unit.

FIG. 4 and FIG. 5 are diagrams showing a configuration of the drum unit 50. FIG. 4 is a perspective view showing an outer appearance of the drum unit 50. FIG. 5 is a cross-sectional view of the drum unit 50 taken along a vertical plane that passes through the center of the rotation shaft 62. As shown in FIG. 4 and FIG. 5, the drum unit 50 is elongated in one direction. As shown in FIG. 4, the drum unit 50 is provided in the housing 10A such that its longitudinal direction matches the left-right direction 9 of the image forming apparatus 10. It is noted that in the following description, the up-down direction 7, the front-rear direction 8, and the left-right direction 9 are defined for the drum unit 50 based on the state where the drum unit 50 is attached to the inside of the housing 10A.

The drum units 50 are disposed at predetermined attachment positions in the housing 10A. The drum units 50 are slidably supported by an inner frame or the like of the housing 10A such that they can be inserted and pulled out horizontally with respect to the housing 10A. In the present embodiment, the drum units 50 can be horizontally inserted along the left-right direction 9 from the right side of the housing 10A, and pulled out in a direction reverse to the insertion direction. When the drum units 50 are inserted into the innermost portion of the housing 10A and attached to the attachment positions, the image formation becomes available.

Here, as the image formation is repeatedly performed, the photoconductive layers on the surfaces of the photoconductor drums 51 of the drum units 50 are gradually deteriorated or worn. When the photoconductive layers are deteriorated, chargeability is reduced; and when the photoconductive layers are worn out, the surfaces of the photoconductor drums 51 are not charged to a certain potential, both resulting in reduction of image quality. As a result, the photoconductor drums 51 need to be replaced at a predetermined replacement timing. In the present embodiment, the photoconductor drums 51 are respectively provided in the drum units 50. As a result, when the photoconductor drums 51 are replaced, the drum units 50 need to be pulled out from the housing 10A. In addition, when maintenance is performed to the inside of the image forming apparatus 10, the drum units 50 need to be pulled out as necessary.

The frame 54 is a housing of the drum unit 50. The frame 54 is elongated in one direction. The frame 54 is detachably attached to the inner frame or the like of the housing 10A in a state where its longitudinal direction matches the left-right direction 9. The frame 54 supports opposite ends of the rotation shaft 62. The rotation shaft 62 supports the photoconductor drum 51 such that the photoconductor drum 51 can rotate around the rotation shaft 62. The frame 54 includes support portions 63 and 64 that are separated from each other in the left-right direction 9. The rotation shaft 62 is rotatably supported by the support portions 63 and 64. In addition, the frame 54 includes a side cover portion 61 that covers a rear-side part of the circumferential surface of the photoconductor drum 51. The side cover portion 61 extends along the left-right direction 9, connecting the support portion 63 and the support portion 64. The cleaning member is provided inside the side cover portion 61.

As shown in FIG. 5, a flange 65 (see FIG. 5) is provided on a left end portion 51A, which is one of opposite end portions of the photoconductor drum 51, located on the left side. Specifically, the flange 65 is provided on the left end portion 51A on the side of an insertion direction D1 when the drum unit 50 is inserted in the housing 10A. The flange 65 is integrally fixed to (coupled with) the photoconductor drum 51 by being fitted in an inner hole of the left end portion 51A of the photoconductor drum 51. A flange 71 (see FIG. 5) is provided on a right end portion 51B, which is the other of the opposite end portions of the photoconductor drum 51, located on the right side. The flange 71 is integrally fixed to (coupled with) the photoconductor drum 51 by being fitted in an inner hole of the right end portion 51B of the photoconductor drum 51.

A shaft hole 66 (see FIG. 6) is formed at a central portion of the flange 65, and a shaft hole (not shown) is formed at a central portion of the flange 71. The rotation shaft 62 is rotatably inserted in the shaft hole 66 of the flange 65 and the shaft hole of the flange 71.

The rotation shaft 62 passes through the support portion 63 and protrudes to the left side. On the other hand, an input gear 69 is provided on the inner frame of the housing 10A, wherein the input gear 69 is configured to receive a rotational driving force transmitted from a driving source such as a motor (not shown). When the drum unit 50 is attached to the housing 10A, a left end portion 62A of the rotation shaft 62 is inserted in a shaft hole formed at the center of the input gear 69. The rotational driving force is transmitted from the input gear 69 to the flange 65 via a joint 74 that is described below, and is further transmitted from the flange 65 to the photoconductor drum 51. Upon receiving the rotational driving force, the photoconductor drum 51 rotates around the rotation shaft 62 in a predetermined rotation direction.

Figure 6:
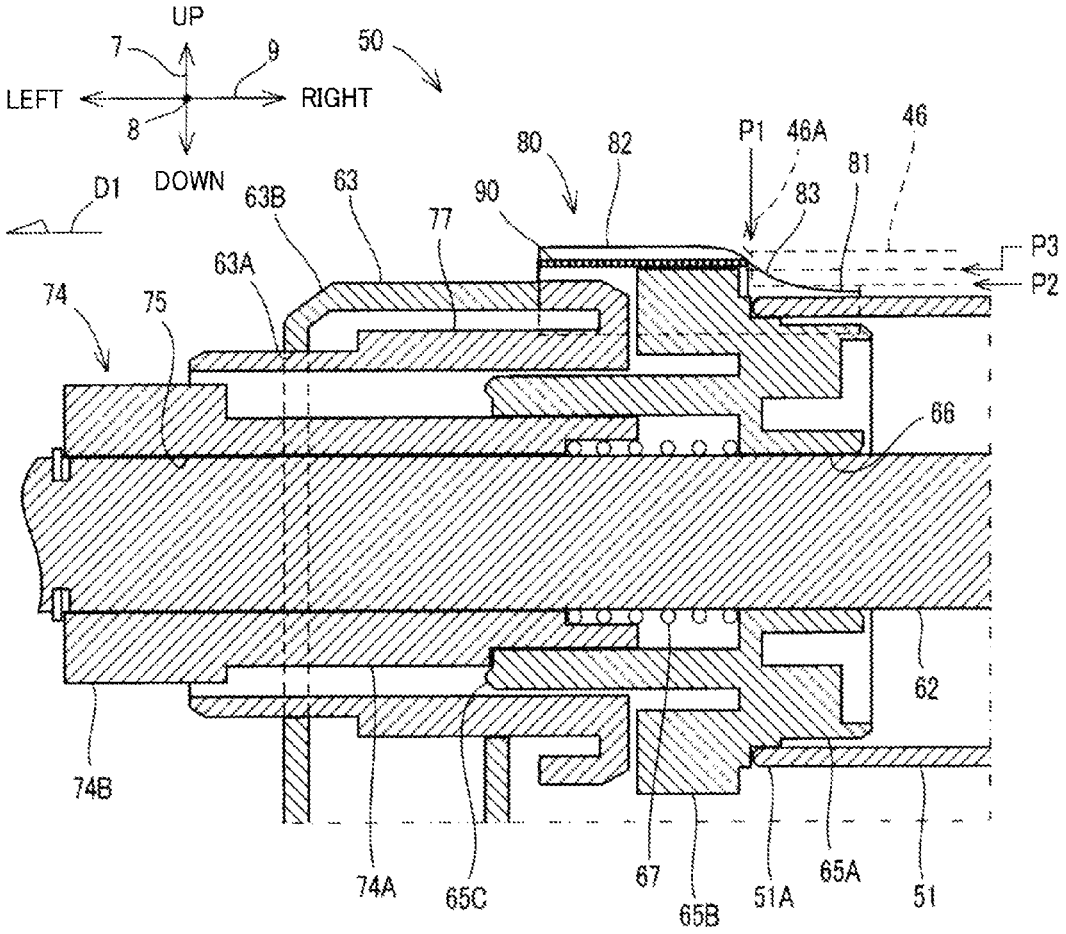
FIG. 6 is an enlarged view of a main part VI shown in FIG. 5, and shows a configuration of a left end portion of the photoconductor drum.

As shown in FIG. 6, the flange 65 is attached to the left end portion 51A of the photoconductor drum 51. The flange 65 is a resin member formed from a crystalline resin, such as polyacetal (POM) that has small friction coefficient and good slidability. The flange 65 is engaged and coupled with a cylindrical portion 74A of the joint 74 in a circumferential direction, wherein the cylindrical portion 74A and the joint 74 are described below. This enables the flange 65 to receive the rotational driving force from the joint 74.

Specifically, the flange 65 includes a pressure input portion 65A, a gear portion 65B, and a shaft portion 65C, and these portions are integrally formed by a metal molding. The flange 65 is formed from a resin member.

The pressure input portion 65A is a cylindrical portion protruding from the right side surface of the gear portion 65B outward (rightward) in the axial direction. The pressure input portion 65A is inserted and fitted in the inner hole of the photoconductor drum 51 by pressure. This allows the pressure input portion 65A to be fixed to the photoconductor drum 51. It is noted that the shaft hole 66 is formed at the central portion of the flange 65, more specifically at the central portion of the pressure input portion 65A. The rotation shaft 62 is inserted in the shaft hole 66.

The gear portion 65B is integrally formed on the outer circumferential surface of the flange 65. The outer diameter of the gear portion 65B is larger than the diameter size of the photoconductor drum 51. The gear portion 65B is coupled with a cleaning roller (not shown) for cleaning the charging roller 52 so that drive can be transmitted. During a rotation of the photoconductor drum 51, the rotational driving force is transmitted from the gear portion 65B to the input gear of the cleaning roller, and the cleaning roller for the charging roller 52 is rotated. To provide excellent transmission of the rotational driving force and reduce the driving sound and wear during the connection driving, lubricant such as silicone grease is applied to the gear portion 65B. It is noted that in the present embodiment, the gear portion 65B is a helical gear that has teeth inclined in the axial direction. Of course, the gear portion 65B may be a spur gear or a bevel gear.

The shaft portion 65C protrudes from the left side surface of the gear portion 65B outward (leftward) in the axial direction. In a state where the pressure input portion 65A of the flange 65 is fixed to the left end portion 51A of the photoconductor drum 51, the shaft portion 65C protrudes outward in the axial direction from the center of the left side surface of the gear portion 65B. The shaft portion 65C is smaller in diameter than the gear portion 65B and the pressure input portion 65A. The shaft portion 65C is formed in the shape of a cylinder whose inside is hollow. The inner diameter of the shaft portion 65C is larger than the outer diameter of the cylindrical portion 74A of the joint 74. As a result, the cylindrical portion 74A can be inserted in an inner hole of the shaft portion 65C. In the present embodiment, the cylindrical portion 74A is inserted in the inner hole of the shaft portion 65C, and the flange 65 and the joint 74 are engaged and coupled with each other in the circumferential direction. For example, an engaging rib (not shown) extending in the axial direction is provided on the outer circumferential surface of the cylindrical portion 74A, an engaging groove (not shown) extending in the axial direction is provided on the inner surface of the shaft portion 65C, and when the cylindrical portion 74A is inserted in the inner hole of the shaft portion 65C, the engaging rib is inserted in the engaging groove. This makes it possible for the shaft portion 65C and the cylindrical portion 74A to be coupled with each other in the circumferential direction, and move relative to each other in the axial direction.

The joint 74 is provided on the left side of the flange 65. The joint 74 receives the rotational driving force input to the input gear 69, and transmits the rotational driving force to the flange 65. As shown in FIG. 6, the joint 74 includes a cylindrical portion 74A and a cylindrical portion 74B that are different in outer diameter. The cylindrical portion 74A is smaller than the cylindrical portion 74B in outer diameter. In the joint 74, the cylindrical portion 74A is provided on the flange 65 side, and the cylindrical portion 74B is provided on the opposite side (on the input gear 69 side). In addition, a shaft hole 75 is formed at the center of the joint 74, wherein the shaft hole 75 is common to the cylindrical portion 74A and the cylindrical portion 74B. The rotation shaft 62 is inserted in the shaft hole 75. The cylindrical portion 74B has an engaging groove (not shown) that can be coupled with the input gear 69. When the joint 74 is biased by a coil spring 67 that is described below, the input gear 69 and the cylindrical portion 74B are engaged in the rotation direction, and the joint 74 and the input gear 69 are coupled with each other.

As shown in FIG. 6, the coil spring 67 is provided between the flange 65 and the joint 74. The coil spring 67 biases the joint 74 outward (leftward) in the axial direction by a predetermined spring force (elastic force). In the present embodiment, the coil spring 67 acts as a compression spring, and is attached to the hollow portion of the shaft portion 65C of the flange 65. In this state, the cylindrical portion 74A is inserted in the inner hole of the shaft portion 65C. This makes it possible for the coil spring 67 to elastically bias the joint 74 outward (leftward) in the axial direction.

A cylindrical protection cover 77 is provided to cover the cylindrical portion 74A of the joint 74 and the shaft portion 65C of the flange 65. The protection cover 77 is inserted in an opening 63A formed in the support portion 63 such that a part of the protection cover 77 is exposed to outside. An inclined surface 63B is formed on an upper end portion of the support portion 63 on the side of the insertion direction D1. The inclined surface 63B plays a role of a guide surface that, when the drum unit 50 is inserted in the housing 10A, abuts on an edge portion of the transfer belt 46 and guides the edge portion to rise upward.

Here, in the drum unit 50, in a case where the outer diameter (addendum circle diameter) of the gear portion 65B of the flange 65 is larger than the outer diameter of the photoconductor drum 51, when the drum unit 50 is pulled out of the housing 10A during replacement or maintenance, the gear portion 65B may be caught by an edge portion 46A of the transfer belt 46, and the edge portion 46A may be damaged. As a result, conventionally, a well-known retreating mechanism is provided in the image forming apparatus 10, such as a mechanism that, when the drum unit 50 is pulled out, lowers the drum unit 50 in a direction (downward) away from the transfer belt 46, or a mechanism that moves the transfer belt 46 upward before the drum unit 50 is pulled out. However, since, as described above, the transfer belt 46 is formed from a resin member and suspended between the driving pulley 5A and the driven pulley 5B with a predetermined tension, slack would be generated on the transfer belt 46. As a result, when the transfer belt 46 and the photoconductor drum 51 are relatively separated from each other by the retreating mechanism, the transfer belt 46 may be in a state of being in contact with the photoconductor drum 51. When the drum unit 50 is pulled out in such a state, the gear portion 65B would be caught by the edge portion 46A of the transfer belt 46 that is located on the side of the insertion direction D1. Even if the gear portion 65B is not caught by the edge portion 46A, if the gear portion 65B contacts the surface of the edge portion 46A during the pulling out, the lubricant applied to the gear portion 65B adheres to the surface of the transfer belt 46. This may reduce adhesion or transferability of the toner image on the surface of the transfer belt 46, and cause reduction in image quality.

In view of the above-described problem, in the drum unit 50 of the present embodiment, a guide member 80 is provided on the upper surface of the side cover portion 61 of the frame 54. Furthermore, a film member 90 (an example of the cover member of the present disclosure) is provided so as to cover the gear portion 65B of the flange 65. The provision of the guide member 80 and the film member 90 prevents the gear portion 65B of the flange 65 from contacting the transfer belt 46 when the drum unit 50 is pulled out.

The guide member 80 guides the edge portion 46A (see FIG. 6) of the transfer belt 46 upward when the drum unit 50 is pulled out of the housing 10A. As shown in FIG. 4, the guide member 80 is provided on the frame 54. Specifically, the guide member 80 is provided on the upper surface of the side cover portion 61. The guide member 80 may be integrally formed with the frame 54. In addition, the guide member 80 may be a member provided independently of the frame 54. In a case where the guide member 80 is provided independently of the frame 54, the guide member 80 is attached to the upper surface of the side cover portion 61 by adhesive, double-sided tape or the like.

In the present embodiment, the guide member 80 is provided on the upper surface of the side cover portion 61 near an end of the side cover portion 61 on the side of the insertion direction D1. The guide member 80 extends on both sides of an edge position P1 (see FIG. 6) along the left-right direction 9 (insertion and pulling out direction of the photoconductor drum 51), wherein the edge position P1 is a position at which the edge portion 46A of the transfer belt 46 is disposed in the state where the drum unit 50 is disposed at the attachment position in the housing 10A.

As shown in FIG. 6, the upper surface of the guide member 80 includes a first guide surface 81, a second guide surface 82 and an inclined guide surface 83. The first guide surface 81 is a part of the upper surface of the guide member 80, and located more on the side of the center of the photoconductor drum 51 than the edge position P1. The second guide surface 82 is another part of the upper surface of the guide member 80, and located more on the side of the insertion direction D1 than the edge position P1. The inclined guide surface 83 is formed in an area that extends on both sides of the edge position P1, between the first guide surface 81 and the second guide surface 82. In the present embodiment, the first guide surface 81 is lower than a height position P2, which is a height position of a lower end of the edge portion 46A in the up-down direction 7 (height direction). In addition, the second guide surface 82 is higher than the height position P2 and an upper-end position P3, wherein the upper-end position P3 is a height position of an upper end of the gear portion 65B.

With the guide member 80 configured as described above being provided in the drum unit 50, when the drum unit 50 is pulled out from the attachment position in the housing 10A, first the guide member 80 abuts on the edge portion 46A of the transfer belt 46. Then, during the process of pulling out the drum unit 50, the edge portion 46A is guided from the first guide surface 81 to the inclined guide surface 83, and then to the second guide surface 82. This causes the edge portion 46A to rise to at least the upper-end position P3 of the gear portion 65B. As a result, the gear portion 65B does not contact the edge portion 46A when the drum unit 50 is pulled out of the housing 10A. This prevents the edge portion 46A from being damaged by contact.

It is noted that in the case where the guide member 80 is provided independently of the frame 54, the guide member 80 is not necessarily formed from the resin member as the frame 54 is, but may be formed from a material that is soft enough to absorb the impact of the contact with the edge portion 46A, and rigid enough to raise the edge portion 46A upward at the contact.

As shown in FIG. 4, the film member 90 is attached to the support portion 63 of the frame 54 to cover the gear portion 65B of the flange 65. The gear portion 65B is coupled with the input gear of the charging roller 52. As a result, in the present embodiment, the film member 90 is attached in such a way as to cover an area excluding a lower end portion of the gear portion 65B where the gear portion 65B is coupled with the input gear. Specifically, the film member 90 is attached in such a way as to cover an upper area of the outer circumferential surface of the gear portion 65B. The film member 90 is formed in a curved shape along the outer circumferential surface of the gear portion 65B. An end portion 91 (see FIG. 7A), which is one of opposite end portions of the film member 90, is fixed to the guide member 80, and an end portion 92 (see FIG. 7A), which is the other of the opposite end portions of the film member 90, is fixed to the support portion 63.

Figure 7A:
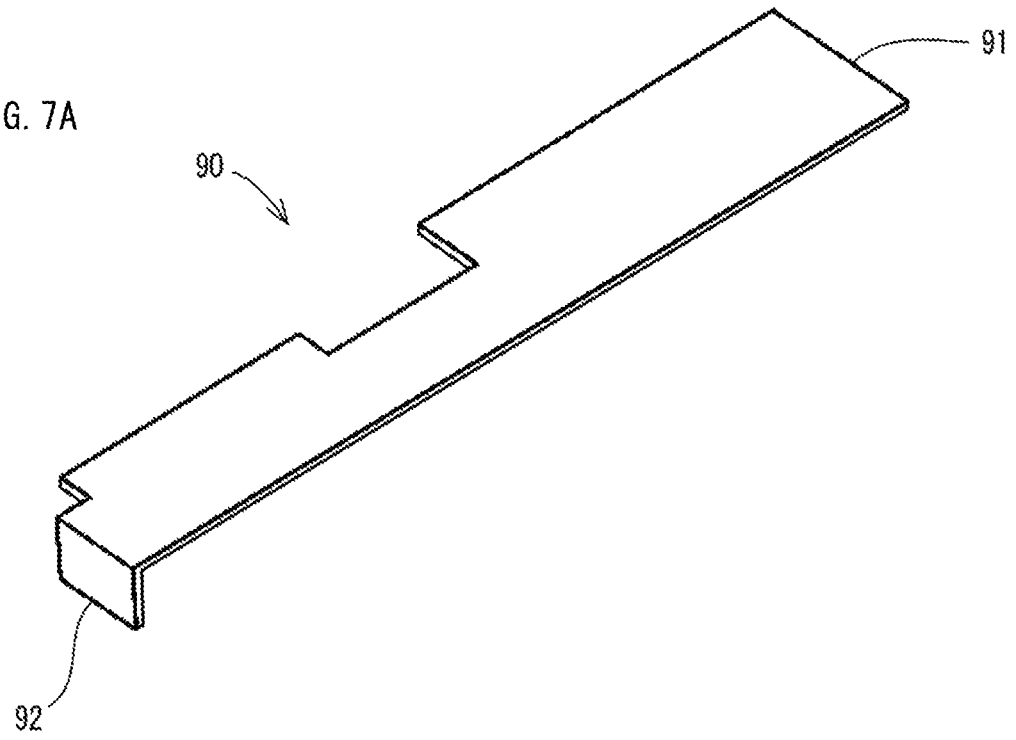
FIG. 7A and FIG. 7B are diagrams showing a film member attached to a flange of the photoconductor drum.
Figure 7B:
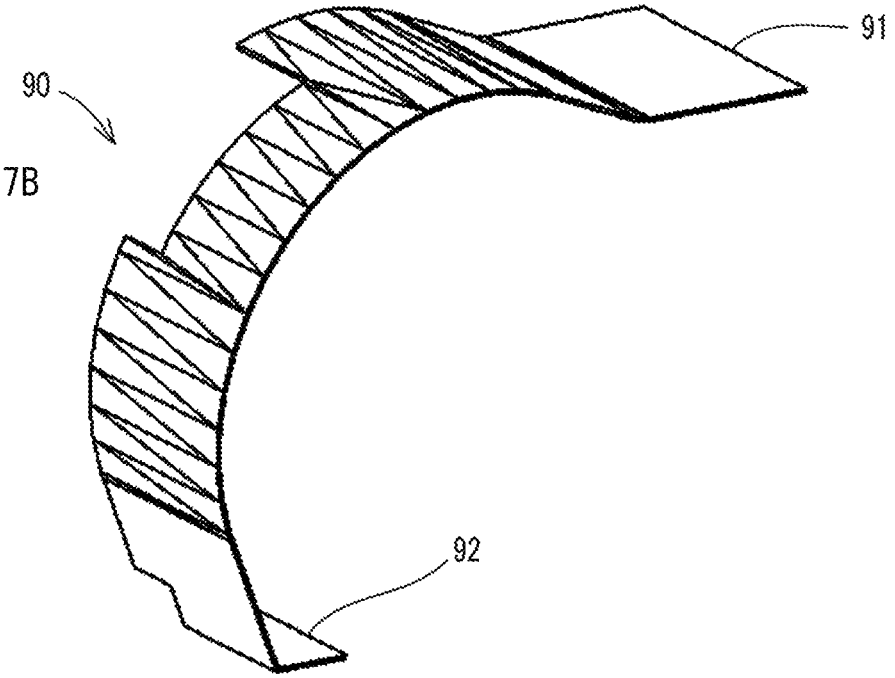

The film member 90 is a film made of, for example, polyester. As shown in FIG. 7A and FIG. 7B, the end portion 92 is approximately vertically bent, and the film member 90 is fixed when the end portion 92 is inserted in a slit-like groove formed in the support portion 63. In addition, a slit-like groove extending horizontally is formed in a side surface of the guide member 80, and the film member 90 is fixed when the end portion 91 is inserted in this groove.

As shown in FIG. 6, the film member 90 protrudes in the insertion direction D1 from an end portion of the gear portion 65B on the side of the insertion direction D1.

With the film member 90 configured as described above being provided, the gear portion 65B does not directly contact the lower surface of the transfer belt 46 when the drum unit 50 is pulled out. As a result, the lubricant applied to the gear portion 65B does not adhere to the lower surface of the transfer belt 46. This prevents reduction of adhesion or transferability of the toner image on the lower surface of the transfer belt 46.

In addition, with the configuration where the film member 90 protrudes in the insertion direction D1 from an end portion of the gear portion 65B on the side of the insertion direction D1, even if the lubricant moves in the insertion direction D1 from the gear portion 65B when the flange 65 is rotated, the lubricant is prevented from climbing over the film member 90 and moving to the transfer belt 46 located at a higher position. In particular, in a case where a helical gear is used as the gear portion 65B, and the helical gear is inclined toward the upstream in the rotation direction of the flange 65, the lubricant is apt to move in the insertion direction D1. According to the present embodiment, the film member 90 protrudes in the insertion direction D1 from an end portion of the gear portion 65B on the side of the insertion direction D1. This configuration effectively prevents the lubricant from adhering to the transfer belt 46.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body;

a drum unit attached, in a detachable manner, to a predetermined attachment position inside the apparatus main body, the drum unit including a cylindrical photoconductor drum and configured to be inserted and pulled out horizontally with respect to the apparatus main body; and a transfer belt disposed above the photoconductor drum in such a way as to face and contact an outer circumferential surface of the photoconductor drum in a state where the drum unit is disposed at the attachment position, wherein the drum unit includes:

a flange integrally provided with the photoconductor drum by being fixed to an inner hole of a side end portion of the photoconductor drum, the side end portion being on a downstream side of the photoconductor drum in an insertion direction of the drum unit opposite to a pulling out direction;

a frame configured to rotatably support the photoconductor drum and cover a side of the photoconductor drum;

a gear portion integrally formed with an outer circumferential surface of the flange, an outer diameter of the gear portion being larger than a diameter size of the photoconductor drum; and a guide member provided on an upper surface of the frame and extending in the insertion direction and the pulling out direction on both sides of an edge position, the edge position being a position at which an edge portion, on the downstream side, of a surface of the transfer belt facing the photoconductor drum, is disposed in the state where the drum unit is disposed at the attachment position, the guide member being configured to guide the edge portion upward when the drum unit is pulled out of the apparatus main body, and an upper surface of the guide member includes a first guide surface and a second guide surface, the first guide surface being located more on a side of a center of the photoconductor drum than the edge position, the second guide surface being located more on the downstream side than the edge position, the first guide surface being lower than a height position of a lower end of the edge portion, the second guide surface being higher than an upper-end position of the gear portion.

2. The image forming apparatus according to claim 1, wherein the guide member includes an inclined guide surface in an area extending from the first guide surface to the second guide surface.

3. The image forming apparatus according to claim 1, further comprising:

a transmitted portion coupled with a lower end portion of the gear portion, a rotational driving force being transmitted to the transmitted portion from the gear portion when the photoconductor drum is rotated, wherein the drum unit includes:

a film-like cover member covering an upper-side part of an outer circumferential surface of the gear portion.

4. The image forming apparatus according to claim 3, wherein the cover member is formed in a curved shape along the outer circumferential surface of the gear portion, and at least one end of the cover member is fixed to the guide member.

* * * * *